United States Patent [19]

Bick

[11] Patent Number: 4,721,189

[45] Date of Patent: Jan. 26, 1988

[54] RETARDERS SUITABLE FOR WAGON SPEED CONTROL

[75] Inventor: David E. Bick, Newent, England

[73] Assignee: Dowty Hydraulic Units Limited, Cheltenham, England

[21] Appl. No.: 831,364

[22] Filed: Feb. 19, 1986

[30] Foreign Application Priority Data

Feb. 27, 1985 [GB] United Kingdom ..... 8505059

[51] Int. Cl.[4] ..... B61K 7/02; F16F 9/49; B61B 1/00

[52] U.S. Cl. ..... 188/62; 104/26.2; 188/280

[58] Field of Search ..... 188/32, 62, 63, 280, 188/301, 317; 267/64.11, 64.15, 64.26, 113, 120, 124, 140.1, 136, 139; 104/162, 26.2

[56] References Cited

U.S. PATENT DOCUMENTS 3,542,212 11/1970 Daugherty ..... 188/280 X 3,637,052 1/1972 Bick ..... 188/62

4,474,271 10/1984 Molders et al. ..... 188/62 X

*Primary Examiner*—Andres Kashnikow

*Assistant Examiner*—Robert J. Oberleitner

*Attorney, Agent, or Firm*—Hayes, Davis & Soloway

[57] ABSTRACT

A retarder, suitable when mounted in association with a rail of a railway track for reducing the speed of a wagon rolling along the track, includes an hydraulic unit which comprises a hollow member, a piston slidably housed in that member, and a piston rod. A portion of the hydraulic unit is, for retardation of the wagon, disposed in the path of a wagon wheel. When that portion is engaged, directly or indirectly, by a wheel it is deflected by, and out of the path of, the wheel to permit the wheel to pass the retarder. The ratio of the diameter of the piston to the diameter of the piston rod is in the range 2.80:1 to 6.00:1 and the ratio of the diameter of the piston to the length of stroke of the hydraulic unit is in the range 0.53:1 to 1.20:1.

6 Claims, 1 Drawing Figure

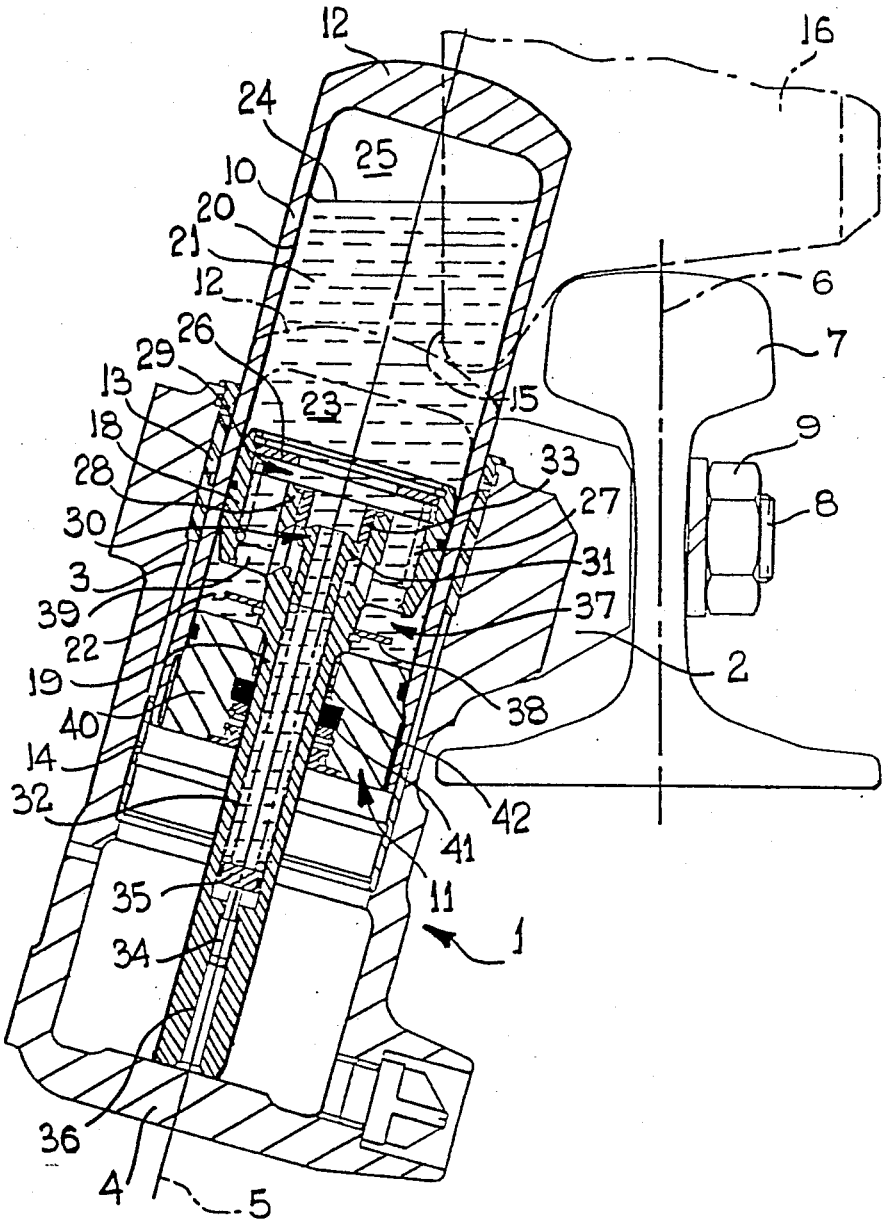
12
16
24
25
10
20
21
12
6
7
26
29
13
23
15
18
9
28
33
27
8
30
31
3
37
39
22
2
19
38
40
14
42
32
41
35
11
1
34
36
4
5

RETARDERS SUITABLE FOR WAGON SPEED CONTROL

This invention relates to retarders of the kind suitable for reducing the speed of a wagon in which the movement of a wheel of the wagon, for example along a rail of a railway track, is opposed by an hydraulic device acting against the periphery of the wheel.

Hitherto certain such retarders have included an hydraulic unit having a piston and piston rod, and a portion of that unit has been deflectable directly or indirectly by the periphery of a wheel rolling along a rail. One such retarder in which that portion is directly engageable by the periphery of a wheel is the subject of U.S. Pat. No. 3,637,052, this having particular application in railway marshalling yards, for example for use in retarding wagons being shunted into sidings.

Hitherto also the ratio of the diameter of the piston of the hydraulic unit to the diameter of the piston rod thereof has in such certain retarders been relatively low, for example not substantially exceeding 2.50:1 due mainly to structural limitations and the need for compactness and economy on cost of materials. Further the ratio of the diameter of the piston to the available length of stroke of the unit has in such retarders also been relatively low, for example not substantially exceeding 0.50:1. With experience in the manufacture and use of such retarders, over recent years we have come to appreciate that such limitations have been at the expense of performance characteristics and that if the above-mentioned ratio of 2.50:1 could be substantially exceeded important gains in performance of the retarders could be achieved. Furthermore, provided this ratio of 2.50:1 and also the above-mentioned ratio of 0.50:1 are not exceeded to too great an extent, economies in cost and manufacture could still be obtained by careful design and a degree of compactness still achieved, yet maintaining adequate strength of components of the retarder.

Thus it is an object of this invention to provide an improved retarder suitable for wagon speed control.

According to this invention a retarder, suitable when mounted upon or adjacent a rail of a railway track for reducing the speed of a wagon rolling along said track, includes an hydraulic unit comprising a hollow member, a piston slidably housed in said member, and a piston rod, and a portion of that unit, for retardation of said wagon, is disposed in the path of a wheel of said wagon, said portion when engaged, directly or indirectly, by a said wheel being deflected by, and out of the path of, said wheel to permit the wheel to pass the retarder, wherein the ratio of the diameter of said piston to the diameter of said piston rod is in the range 2.80:1 to 6.00:1 and the ratio of the diameter of said piston to the available length of stroke of said unit is in the range 0.53:1 to 1.20:1.

The hydraulic unit is preferably partly filled with hydraulic liquid and also contains gas which is compressed, thereby to act as a spring for effecting telescopic extension of said unit.

The piston may be provided with valve means capable of restricting the flow of liquid from one side of the piston to the other side thereof during telescoping of said unit.

The retarder may include a retainer arranged for fitment to said track and in this case said hydraulic unit is fitted in said retainer, said portion thereof normally projecting from the retainer into said path of a wheel and being movable in a direction inwardly of said retainer by said wheel when coming into engagement with said portion.

Preferably said hollow member forms said portion of said unit and in this case the free end of said piston rod engages a base portion of said retainer.

One way of carrying out the invention is described in detail below with reference to the accompanying cross-sectional drawing.

In the drawing the retarder 1 comprises a retainer 2 having a bore 3 which is open at its upper end and which is closed at its lower end by the base portion 4 of the retainer. The axis 5 of bore 3 is inclined as shown to the vertical plane 6 of a rail 7 of a railway track in a siding of a marshalling yard. The retainer is secured to the inner side face of that rail by two studs and two nuts, one of each of which is shown at 8 and 9 respectively. A hollow member comprising a cylinder 10 forms one portion of an hydraulic unit of the retarder. This cylinder which is closed and domed at 12 at its upper end is slidable and rotatable in bushes 13, 14 in bore 3. The domed end 12 is, as indicated by the broken lines in the drawing, engageable by the flange 15 of a wagon wheel, partly shown at 16, when that wheel is rolling along rail 7 and over retarder 1.

In a manner similar to the construction described in the specification of U.S. Pat. No. 3,637,052, a piston 18 of circular cross-section is housed in cylinder 10. This piston is formed integrally with a piston rod 19, also of circular cross-section, having a cross-sectional area which is small compared with that of piston 18. In this embodiment the ratio of the diameter of piston 18 to that of rod 19 is 3.18:1. The free end of rod 19 engages base portion 4 of retainer 2 and piston 18 divides the bore 20 of cylinder 10 into two chambers 21, 22. The cylinder contains hydraulic liquid 23 up to a desired level 24 in chamber 21. Beyond that level chamber 21 contains gas, in this embodiment nitrogen 25, which is compressed to act as a spring for effecting telescopic extension of cylinder 10 with respect to bore 3. In this embodiment the volume of hydraulic liquid introduced into cylinder 10 is 470 c.c. and the volume of nitrogen is 67 c.c.

The piston 18 is provided with an annular plate 26 which is biassed upwardly in the drawing by coil spring 27 and which is co-operable with cylindrical core portion 28, thereby forming a flow-sensitive speed valve 29. A relief valve 30, comprising a hollow frusto-conical element 31 loaded by a coil spring 32 against a seating 33, is provided as shown in the piston 18 and piston rod 19. A screw-threaded insert 34 bears upon a plunger 35 which in turn bears upon the lower end of spring 32. Turning of insert 34, accessible through small bore 36, effects adjustment in the setting of spring 32. A clack valve 37 for controlling recoil of unit 11 comprises an annular plate 38 which is mounted on an enlarged portion of rod 19 immediately adjacent piston 18 and which is co-operable with porting 39 in the piston.

The piston rod passes through an apertured closure member 40 screw-threadedly fitted in the lower end of cylinder 10, a suitable liquid sealing assembly 41 being provided in the wall of the aperture 42 of member 40.

In this embodiment the ratio of the diameter of piston 18 to the stroke of unit 11 is 0.70:1.

In operation the flange 15 of the wheel 16 travelling at low speed along the rail engages the domed end 12 so that cylinder 10 moves downwardly as the rotational axis of the wheel approaches a position vertically over the domed end. The piston 18 and rod 19 do not move so that hydraulic liquid 23 is displaced from the contracting chamber 21 to the expanding chamber 22 through the porting 39 in the piston. The flow-sensitive speed valve 29 does not close at low wheel speed onto core portion 28. There is therefore a relatively small resistance to downward movement of cylinder 10 provided by the moderate pressure of nitrogen 25 in the upper part of chamber 21. The nitrogen pressure serves as spring means to extend the unit 11 as the wheel axis moves away from the position vertically over domed end 12. Hydraulic liquid then flows from chamber 22 to chamber 21 at a rate determined by the partial closure of porting 39 by plate 38 of clack valve 37.

At wheel speeds above a predetermined value the plate 26 of speed valve 29 closes onto core portion 28 so that liquid displaced from chamber 21 must now flow through relief valve 30. This valve is set to generate a pressure in chamber 21 which resists downward movement of cylinder 10 and therefore causes domed end 12 to exert a retarding force against the wheel.

The volume of compressed nitrogen 25 above the level 24 is small compared with the total displacement of liquid 23 from the chamber 21 because it has only to accommodate the total liquid volume displaced by rod 19, and to allow for thermal expansion of the liquid. The small volume of compressed nitrogen 25 above level 24 serves also to cushion the initial impact of a wagon wheel on the retarder.

By so providing an hydraulic unit 11 in which the diameter of piston 18 and the bore of cylinder 10 are relatively large and in which the diameter of piston rod 19 is maintained as small as practicable having regard to necessary rod strength requirements, retarder performance is substantially enhanced. Since a larger liquid/-nitrogen ratio is in consequence provided there is relatively less displaced volume of the rod to be accommodated than in earlier retarders and the higher level of liquid contained in the hydraulic unit results in the hydraulic pressure building up earlier in the stroke of the unit than hitherto so that substantially improved energy absorption by the unit on wagon wheel impact is obtained.

Since cylinder 10 is of larger diameter than hitherto there is no need to provide a mushroom head for engagement by the wheels and thus savings in manufacturing costs are obtained. Also with the above-mentioned piston diameter to unit stroke ratio, since the cylinder and thus the retainer are in consequence shorter in length further such savings can be made and the retainer projects less into ballast deposited along the track. Further, the bigger liquid volume afforded by the larger diameter piston results in less temperature rise in operation of the retarder and more rapid cooling. Since internal pressures reached in the retarder are lower than hitherto longer seal life in the retarder is achieved, lower bearing loads are experienced, and the retarders are less likely to cause wagon wheel lift to occur and thus substantially reduces the risk of wagon derailment in the retarder zone of the marshalling yard.

The invention is not limited to the ratios of piston diameter to piston rod diameter and piston diameter to unit stroke referred to in the embodiment above-described with reference to the drawing, as in other embodiments of this invention the advantages referred to above can, it has been found, be achieved at ratios other than those above specified provided the ratio of piston diameter to piston rod diameter is within the range of 2.80:1 to 6.00:1 and provided the ratio of piston diameter to available length of unit stroke is within the range of 0.53:1 to 1.20:1.

Although in the embodiment above-described with reference to the drawing the cylinder 10 of the hydraulic unit 11 is uppermost, in alternative embodiments of the invention the piston rod of the hydraulic unit is instead uppermost and in this case the wheel is engageable with the hydraulic unit through the intermediary of a further member, for example a cylindrical member itself slidable in the retainer and having a domed upper end engageable by the wheel.

Further, although in the embodiment above-described with reference to the drawing the hydraulic unit 11 is mounted in a retainer itself secured to a rail of the track, in alternative embodiments of the invention the hydraulic unit is not so mounted in a retainer but is instead otherwise suitably installed in association with the track, for example by direct fixing to said rail or by mounting, alongside the rail, in a respective sleeper of the track.

Finally, although in the embodiment above-described with reference to the drawing the piston and its bore and the piston rod of the hydraulic unit are of circular cross-section, in other embodiments the piston and its bore and/or the piston rod may be of suitable cross-section other than truly circular, for example polygonal, oval, fluted or the like, having mean diameters on which the above-mentioned ratio ranges can be based.

I claim:

1. A retarder, suitable when mounted in association with a rail of a railway track for reducing the speed of a wagon rolling along said track, including an hydraulic unit comprising a hollow member, a piston slidably housed in said member, and a piston rod, a portion of that unit, for retardation of said wagon, being disposed in the path of a wheel of said wagon, and said portion when engaged, directly or indirectly, by a said wheel being deflected by, and out of the path of, said wheel to permit the wheel to pass the retarder, wherein the ratio of the diameter of said piston to the diameter of said piston rod is in the range 2.80:1 to 6.00:1 and the ratio of the diameter of said piston to the available length of stroke of said unit is in the range 0.53:1 to 1.20:1.

2. A retarder as claimed in claim 1, wherein said hydraulic unit is partly filled with hydraulic liquid and also contains gas which is compressed, thereby to act as a spring for effecting telescopic extension of said unit.

3. A retarder as claimed in claim 2, wherein said piston is provided with valve means capable of restricting the flow of liquid from one side of the piston to the other side thereof during telescoping of said unit.

4. A retarder as claimed in claim 1, and including a retainer, arranged for fitment to said track and in which said hydraulic unit is fitted, said portion of said unit normally projecting from said retainer into said path of a wheel and being moveable in a direction inwardly of said retainer by said wheel when coming into engagement with said portion.

5. A retarder as claimed in claim 4, wherein said hollow member forms said portion of said unit and the free end of said piston rod engages a base portion of said retainer.

6. A retarder as claimed in claim 1, wherein said hydraulic unit includes a clack valve for controlling recoil of said unit.

* * * * *